US010697258B2

(12) United States Patent
Gupta

(10) Patent No.: US 10,697,258 B2
(45) Date of Patent: Jun. 30, 2020

(54) DUAL RACKING BOARD DRILLING RIG

(71) Applicant: Nabors Drilling Technologies USA, Inc., Houston, TX (US)

(72) Inventor: Ashish Gupta, Houston, TX (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 82 days.

(21) Appl. No.: 15/799,062

(22) Filed: Oct. 31, 2017

(65) Prior Publication Data

US 2019/0024465 A1 Jan. 24, 2019

Related U.S. Application Data

(60) Provisional application No. 62/534,524, filed on Jul. 19, 2017.

(51) Int. Cl.

| | |
|---|---|
| ***E21B 19/14*** | (2006.01) |
| ***E21B 15/00*** | (2006.01) |
| *E21B 19/06* | (2006.01) |
| *E21B 33/14* | (2006.01) |

(52) U.S. Cl.

CPC ..... *E21B 19/14* (2013.01); *E21B 15/00* (2013.01); *E21B 19/06* (2013.01); *E21B 33/14* (2013.01)

(58) Field of Classification Search

CPC ..... E21B 19/06

See application file for complete search history.

(56) References Cited

U.S. PATENT DOCUMENTS

| | | | |
|---|---|---|---|
| 7,246,983 B2 | 7/2007 | Zahn et al. | |
| 8,317,448 B2 | 11/2012 | Hankins et al. | |
| 8,961,093 B2 | 2/2015 | Springett et al. | |
| 9,354,623 B2 | 5/2016 | Magnuson | |
| 2013/0206478 A1* | 8/2013 | Selzer | E21B 19/06 175/52 |

OTHER PUBLICATIONS

Images of a drilling rig in operation before Jul. 19, 2016, 3 pages.

* cited by examiner

*Primary Examiner* — Angela M DiTrani Leff
*Assistant Examiner* — Avi T Skaist
(74) *Attorney, Agent, or Firm* — Haynes and Boone, LLP

(57) ABSTRACT

A method of operating a drilling rig that is located above a wellbore center includes building a casing string stand using a mouse hole that is offset from the wellbore center, wherein the casting string stand comprises two sections of casing; racking the casing string stand in a casing string racking board that is coupled to a mast of the drilling rig, and cementing the casing string stand to a wall of the wellbore. The method further includes racking a drill string stand in a drill string racking board that is coupled to the mast of the drilling rig, wherein the drill string racking board is generally aligned with the casing string racking board in two directions, but is located above the casing string racking board in a third, vertical direction.

19 Claims, 6 Drawing Sheets

DUAL RACKING BOARD DRILLING RIG

CROSS-REFERENCE TO RELATED APPLICATION

This application claims the benefit of the filing date of, and priority to, U.S. application Ser. No. 62/534,524, filed Jul. 19, 2017, the entire disclosure of which is hereby incorporated herein by reference.

BACKGROUND OF THE DISCLOSURE

The present disclosure relates in general to drilling rigs, and in particular to a drilling rig having vertically-spaced dual racking boards.

Drilling operations often require intermittent removal of a drill string from a wellbore in a process sometimes referred to as "tripping out". This occurs, for example, when it is desirable to introduce casing into the wellbore. During this time, rotation of the drill string and circulation of drilling fluids are typically suspended. The drill string is then lifted by lifting equipment attached to a mast located above the wellbore and broken down into stands of pipe. As the stands of pipe are removed from the drill string, each is accommodated within a racking board that is attached to the mast. Generally, sections of casing or liner are not stored vertically in racks that are attached to the mast, but in a horizontal position at a location remote from the drill floor. Thus, each time a section of casing is needed, the section of casing is moved from the location remote from the drill floor, brought from the horizontal position to a vertical position, and then stabbed into the previous casing section that had been inserted into the well. As drilling operations are suspended during casing operations, the time required to move each casing section into position delays drilling operations. The present disclosure is directed to a dual racking board drilling rig and methods that overcome one or more of the shortcomings in the prior art.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
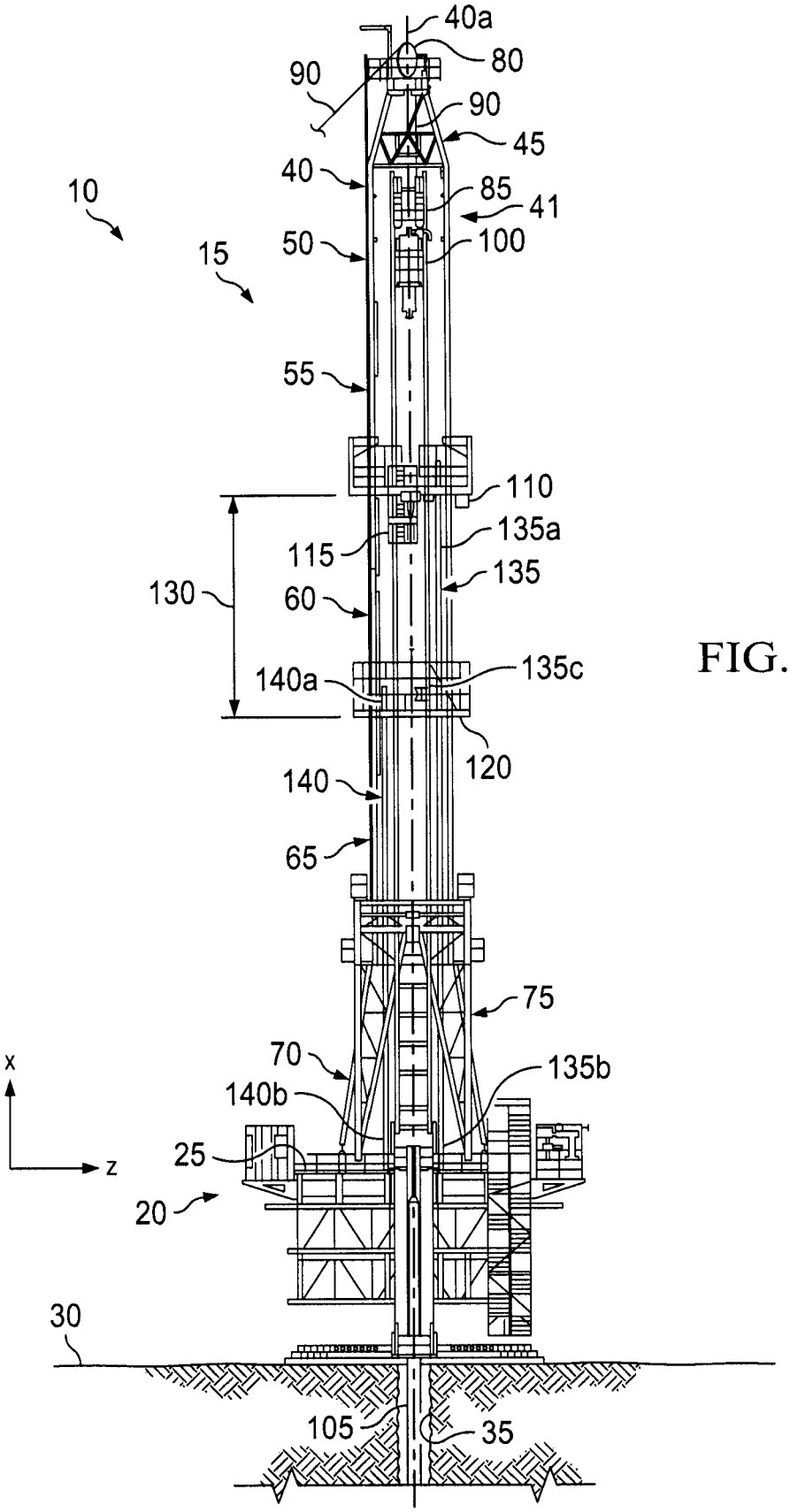
FIG. 1 is side view of a drilling rig according to one or more aspects of the present disclosure, the drilling rig including a first racking board and a second racking board.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

This disclosure is directed to an apparatus that may form all or a part of a land-based drilling rig capable of high capacity or high efficiency drilling operations. The drilling rig includes a vertically extending mast, a tubing string racking board that is sized and configured to rack stands having a total length of between about 100 ft. to about 140 ft., and a casing string racking board. Because the drill string stands—having a total length of between about 100 ft. to about 140 ft.—are capable of being racked in the drill string racking board, the area footprint on the rig floor associated with the racked drill string stands is reduced while the setback capacity remains the same (or is increased). The use of the drill string stands having a total length of between about 100 ft. to about 140 ft. requires fewer connections (performed in an in-line position) between stands than drill string stands having shorter lengths, while still achieving the same total drill string length. Accordingly, make-up and break-down of the drill string while tripping in or tripping out is more efficient, saving time and reducing drilling costs. Moreover, due to the reduced area footprint on the drill floor associated with the racked drill string stands, casing stands can be racked vertically in the casing string racking board. The ability to build casing string stands and rack the casing string stands decreases the time required to position a next section of casing to an in-line position over the wellbore. This use of the casing string stands having a length of between about 85 ft. to 95 ft. requires fewer connections in the in-line position than the use of a single casing string section having a length of about 45 ft., while still achieving the same total casing string length.

Figure 2:
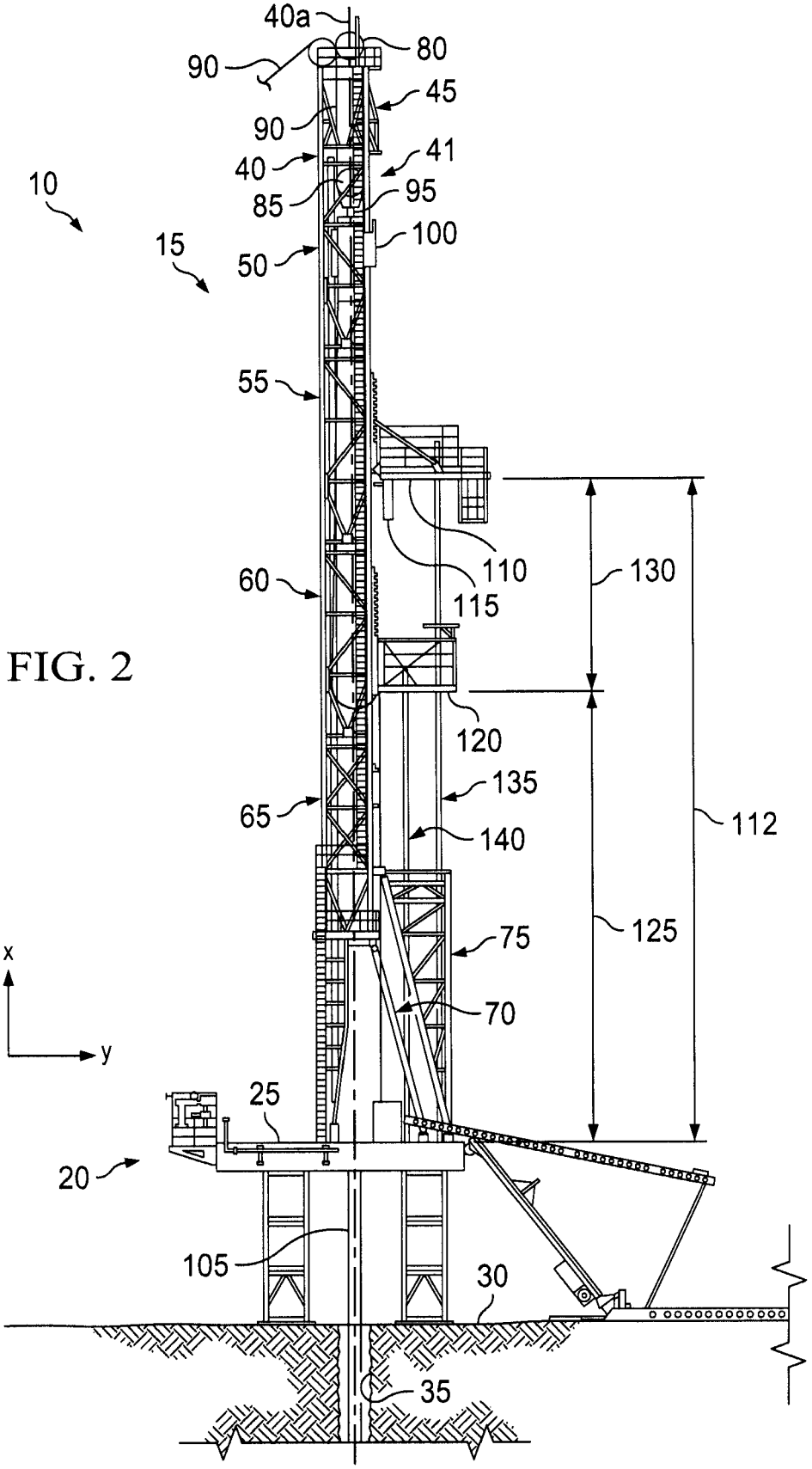
FIG. 2 is another side view of the drilling rig according to one or more aspects of the present disclosure.

Referring to FIGS. 1 and 2, illustrated are two elevation views of apparatus 10. The apparatus 10 may form a part of or may be an entire land-based drilling rig 15. In one embodiment, the drilling rig 15 includes a platform 20 with a platform floor or a drill floor 25. The platform 20 is positioned above and in contact with a pad or directly on a ground surface 30. The platform 20 is positioned above a wellbore 35, which can be an existing wellbore or a planned wellbore.

The apparatus 10 also includes a mast 40 supporting lifting equipment 41 above the drill floor 25. The mast 40 includes a top section 45, an upper intermediate section 50, an upper middle intermediate section 55, a lower middle intermediate section 60, a lower intermediate section 65, and a bottom section 70. A lower mast assist section 75 is also coupled to or forms a portion of the mast 40. The lower mast assist section 75 extends between the drill floor 25 or platform 20 and the mast 40. In an exemplary embodiment, the upper intermediate section 50, the upper middle intermediate section 55, the lower middle intermediate section 60, and the lower intermediate section 65 are each between thirty feet and thirty-seven feet in length. In an exemplary embodiment, each of the intermediate sections 50, 55, 60, and 65 is approximately thirty-four feet in length. In an exemplary embodiment, the upper intermediate section 50 has a top portion that is configured to be coupled to a bottom portion of the top section 45, the middle intermediate section 55 has a top portion that is configured to be coupled to a bottom portion of the upper intermediate section 50, the lower middle intermediate section 60 has a top portion that is configured to be coupled to a bottom portion of the middle intermediate section 55, the lower intermediate section 65 has a top portion that is configured to be coupled to a bottom portion of the lower middle intermediate section 60, and the bottom section 70 has a top portion that is configured to be coupled to a bottom portion of the lower intermediate section 65.

The lifting equipment 41 includes a crown block 80 and a traveling block 85. The crown block 80 is coupled to the top section 45 of the mast 40, and the traveling block 85 hangs from the crown block 80 by a drilling line 90. It should be understood that other conventional techniques for arranging a rig do not require a drilling line, and these are included in the scope of this disclosure. A hook 95 is attached to the bottom of the traveling block 85. A top drive 100 is suspended from the hook 95. Alternatively or in addition, hydraulic elevators (not shown) are attached to the traveling block 85 using bails (not shown) that may be used to raise and lower a drill string 105. A drill string racking board 110, or a monkey board is attached to the middle intermediate section 55. However, the drill string racking board 110 may be attached to any of the sections of the mast 40 at a location adjacent the mast 40 such that the drill string rack board 110 is spaced by a distance 112 above the drill floor 25. In some embodiments, the distance 112 is greater than 110 ft. and less than 125. However, the distance 112 can be any distance within the range of between 100 ft. and 130 ft. For example, the drill string racking board 110 may be located approximately 118 ft. above the drill floor 25. Additional distances, both larger and smaller are also contemplated. An automatic stand transfer vehicle 115 is also attached to the drill string racking board 110. A casing string racking board 120, or monkey board, is attached to the lower middle intermediate section 60. However, the casing string racking board 120 may be attached to any of the sections of the mast 40 at a location adjacent the mast 40 such that the casing string rack board 120 is spaced by a distance 125 above the drill floor 25. In some embodiments, the distance 125 is greater than 70 ft. and less than 100 ft. However, the casing string racking board 120 can be at any height within the range of between 60 ft. above the drill floor 25 and 110 ft. above the drill floor 25. For example, the casing string racking board 120 may be located approximately 79 ft. above the drill floor 25. Additional heights, both larger and smaller are also contemplated. In an exemplary embodiment, the drill string racking board 110 and the casing string racking board 120 are vertically spaced along a longitudinal axis 40*a* of the mast 40 by a distance 130. In some embodiments, the distance is about 29 ft., but can be as large as 40 ft. and as small as 15 ft. Additional vertically spaced distances are also contemplated. While vertically spaced along the axis 40*a*, the boards 110 and 120 extend from the same side of the mast 40 in the same direction (towards the setback side of the rig 15 shown in FIG. 5) such that the boards 110 and 120 are stacked vertically. That is, the casing string racking board 120 is aligned with the drill string racking board 110 in two dimensions, such as the y and z directions, but vertically spaced from each other in the x direction.

In an exemplary embodiment, the drill string racking board 110 accommodates drill string sections, or drill string stands 135 having a total length in the range between 100 ft. and 140 ft. In some embodiments, a drill string stand 135 comprises four (4) sections of pipe, with each section of pipe having a length of between about 27 ft. to 31 ft. In other embodiments, the drill string stand 110 comprises 3 sections of pipe, with each section of pipe having a length of between about 38 ft. to 45 ft. Generally, each drill string stand 135 has a first end portion 135*a*; an opposing second end portion 135*b* that rests on the drill floor 25; and a middle portion 135*c* that extends between the first and second end portions 135*a* and 135*b*. When racked, the first end portion 135*a* is coupled to the drill string racking board 110, the middle portion 135*c* is accommodated within the casing string racking board 120, and the second end portion 135*b* rests on the drill floor 25. The drill string stand 135 has an inner diameter 135*d* and an outer diameter 135*e*. In some embodiments, the outer diameter 135*e* is approximately (within 10%) 4 inches, 4.5 inches, 5 inches, 5.5 inches, or 6.0 inches. However, the outer diameter 135*e* may be less than 4 inches and greater than 6 inches. In an exemplary embodiment, the drill string 105 includes multiple drill string stands 135 coupled together. In an exemplary embodiment, the casing string racking board 120 accommodates casing or liners sections, or casing stands 140 having a total length in the range between 80 ft. and 100 ft. In some embodiments, the casing stands 140 comprise two sections of casing, with each section of casing having a length of between about 40 ft. to 50 ft. In other embodiments, the casing stands 140 have a total length of approximately 90 ft. Generally, each casing stand 140 has a first end portion 140*a* and an opposing second end portion 140*b* that rests on the drill floor 25. When racked, the first end portion 140*a* is coupled to the casing string racking board 120 and the second end portion 140*b* rests on the drill floor 25. The casing stand 140 has an inner diameter 140*c*, which is larger than the outer diameter 135*e* of the drill string stand 135. Generally, the inner diameter 140*c* of the casing stand 140 is greater than the outer diameter 135*e* of the drill string stand 135 such that the drill string stand 135 can extend within a passageway that defines the inner diameter 140*c* of the casing stand 140. In some embodiments, the casing stand 140 has an inner diameter 140*c* that is greater than 4.5 inches, greater than 5 inches, greater than 5.5 inches, or greater than 6.0 inches. However, the inner diameter 140*c* of the casing stand 140 may be less than 4.5 inches. In some embodiments, the inner diameter 140*c* of the casing stand may be any dimension that is greater than 4.5 inches and less than 22 inches. In some embodiments, the casing stand 140 may be any one of a conductor casing, a surface casing, an intermediate casing, a production casing, and a production liner.

Figure 3:
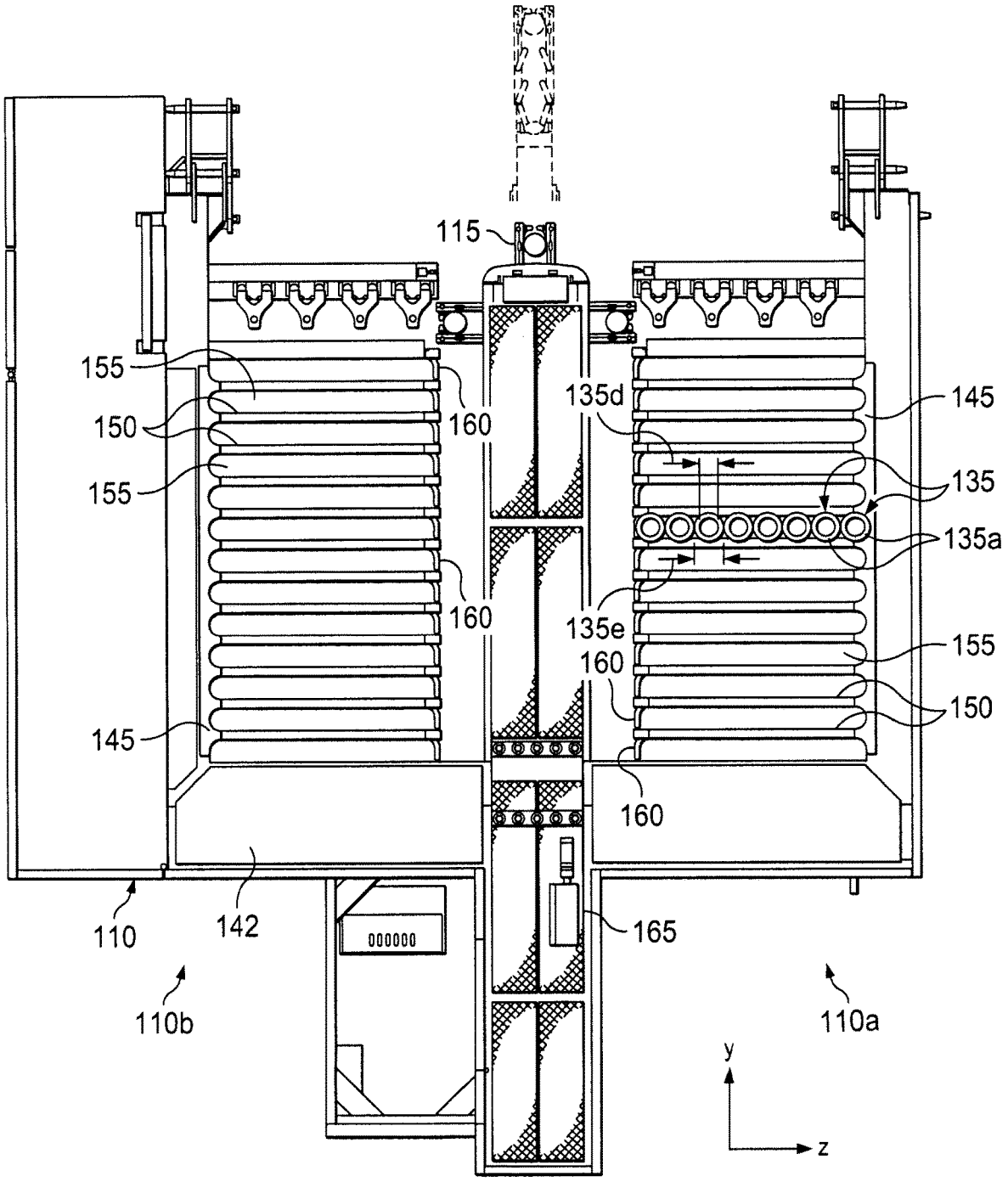
FIG. 3 is a plan view of the first racking board of FIG. 1, according to one or more aspects of the present disclosure.

FIG. 3 shows the drill string racking board 110 in greater detail. In an exemplary embodiment and as illustrated in FIG. 3, the racking board 110 includes a floor 142 and cantilever beams 145 extending perpendicular to the mast 40 (shown in FIG. 1). Arms 150 extend from each of the cantilever beams 145 to form channels 155 that accommodate the drill string stands 135. The drill string stands 135 enter and exit each of the channels 155 via channel openings 160. The automatic stand transfer vehicle 115 includes a track 165 that is adjacent the channel openings 160 and extends parallel to the cantilever beams 145. In some embodiments, a first set of fingers 150 extends in a first direction and a second set of fingers 150 extends in a second direction that is opposite the first direction. The first set of fingers 150 form a first portion 110*a* of the drill string racking board 110 and the second set of fingers 150 form a second portion 110*a* of the drill string racking board 110. Generally, the drill string stands 135 are accommodated within one of the portions 110*a* and 110*b* with the other of the portions 110*a* and 110*b* remaining empty of the drill string stands 135. For example, the drill string stands 135 are accommodated within the first portion 110*a* of the drill string racking board 110.

Figure 4:
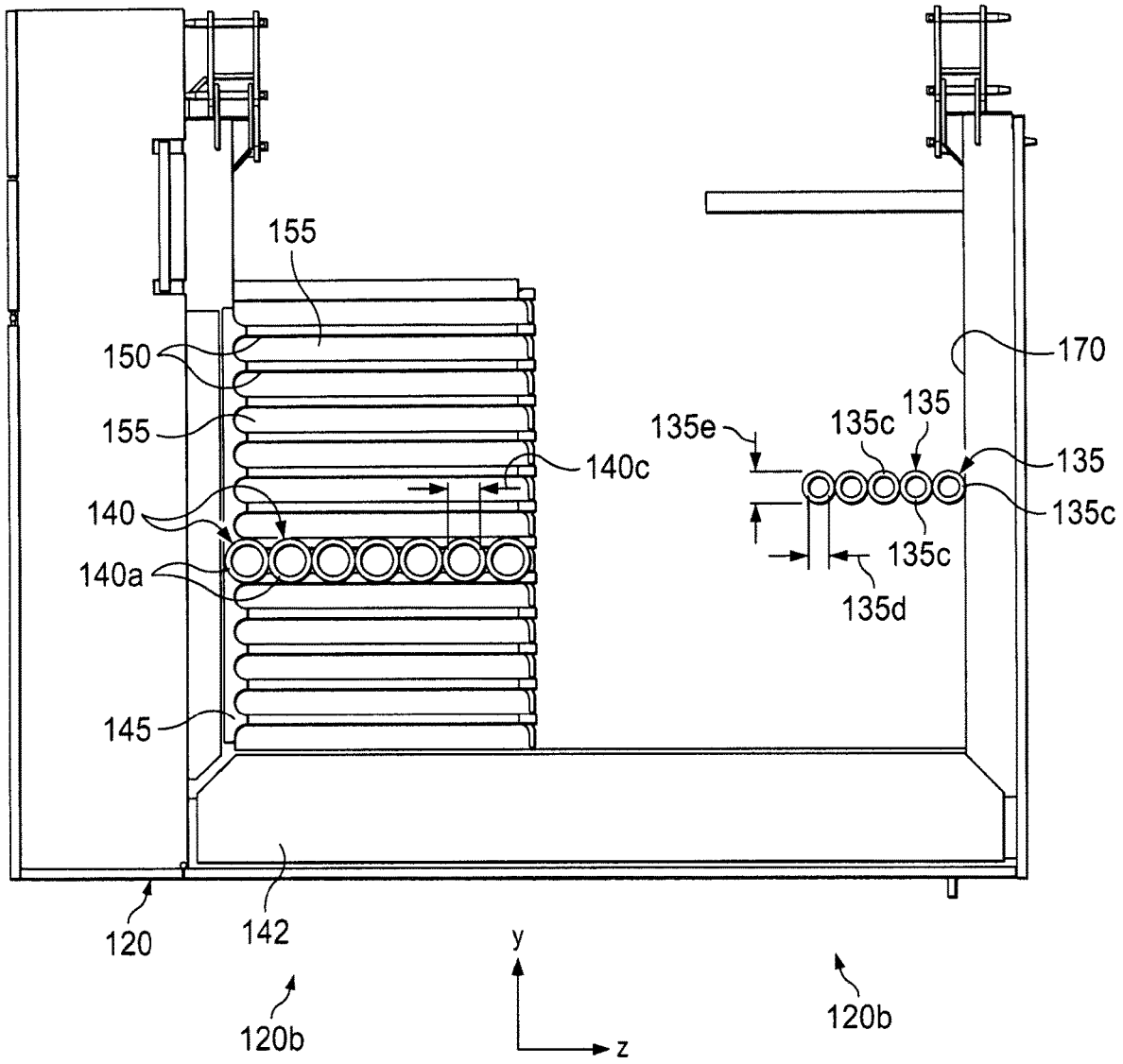
FIG. 4 is a plan view of the second racking board of FIG. 1, according to one or more aspects of the present disclosure.

FIG. 4 shows the casing string racking board 120 in greater detail. In an exemplary embodiment, the casing string racking board 120 is similar to the drill string casing board 110, with the elements common between the casing string racking board 120 and the drill string racking board 110 being identified with the numerals associated with the elements from the drill string racking board 110. That is, the casing string racking board 120 also includes fingers 150 that form channels 155. In some embodiments, the casing string racking board 120 is similar to the drill string casing board 110 except that the casing string racking board 120 is sized and configured to accommodate drill string stands 135 in a first portion 120*a* of the casing string racking board 120 and is sized and configured to rack casing stands 140 in a second portion 120*b* of the casing racking board 120. Generally, the channels 155 in the second portion 120*b* receive and accommodate the first end portions 140*a* of the casing stands 140. In some embodiments and as shown, fingers are omitted from the second portion 120*b* and the drill string stands 135 are accommodated within a vertically extending opening 170 formed in the casing string racking board 120. Generally, the middle portion 135*c* of the drill string stands 135 are accommodated within the opening 170. In some embodiments, the fingers 150 are not omitted from the portion 120*a* of the casing string racking board 120 and instead, the channels 160 formed by the fingers 150 in the portion 120*a* are sized to accommodate the drill string stands 135.

Figure 5:
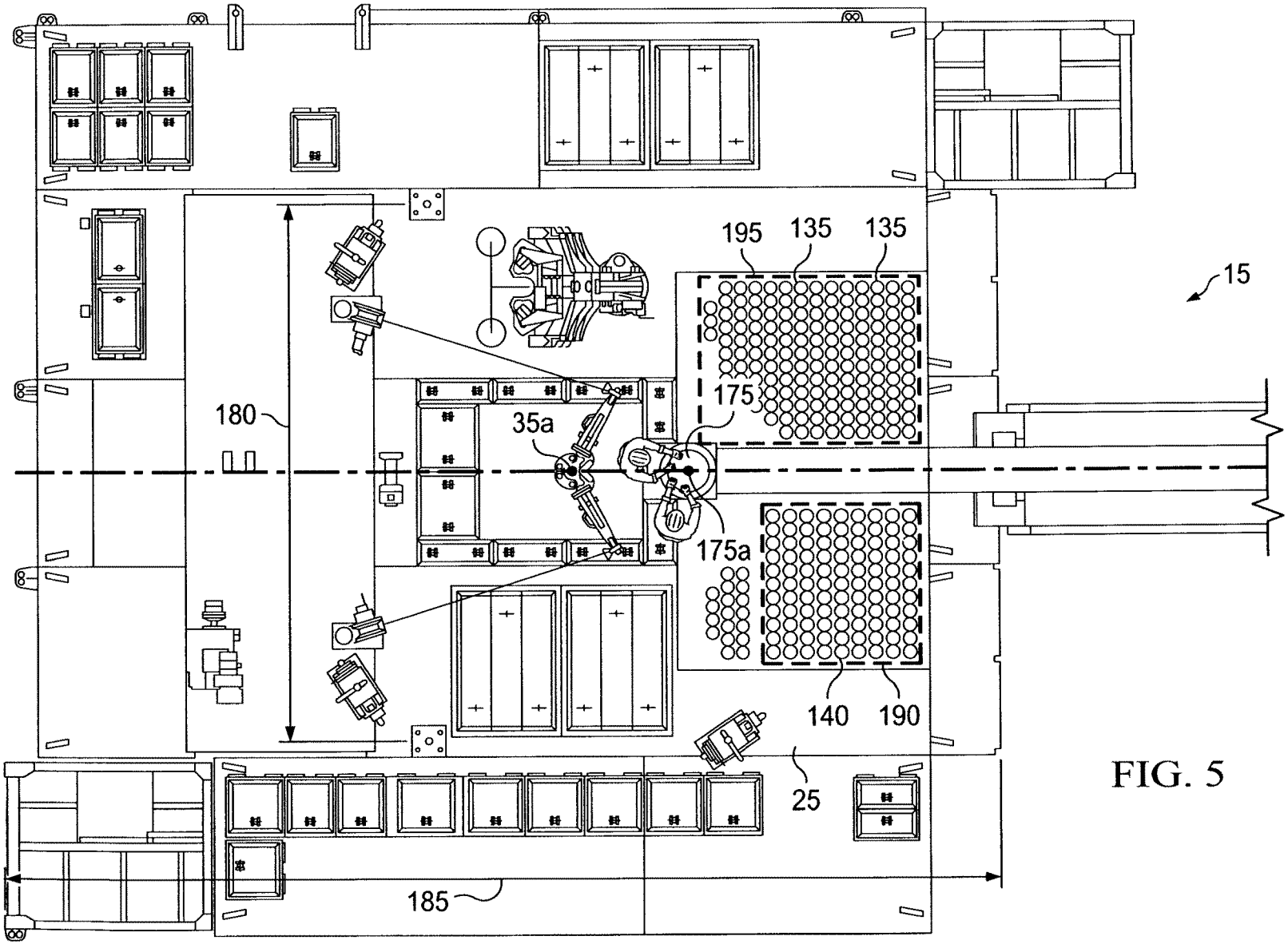
FIG. 5 is a plan view of a drill floor of the drilling rig of FIG. 1, according to one or more aspects of the present disclosure.

FIG. 5 illustrates a plan view of the drill floor 25. As shown, a mouse hole 175, having a center line 175*a*, is offset from a center line 35*a* of the wellbore 35. Thus, stand building of the drill string stands 135 and/or the casing string stands 140 may occur off-well center utilizing the mouse hole 175 that is disposed in a position that allows stand building free from interference with the drilling equipment at well center, such as the top drive 100 for example. As used herein, the term "off-well center" is meant to include a position that does not interfere with drilling equipment at well center. This may encompass at least a portion of the offline position and at least a portion of the online position. In some embodiments, the drill floor 25 has a first dimension 180 between about 20 ft. and about 40 ft. and a second dimension 185 between about 40 ft. and about 60 ft. such that the area of the drill floor surface is between about 800 sq. ft. and about 2,400 sq. ft. In some embodiments, the area of the drill floor surface is about 1,055 sq. ft. Larger and smaller drill floor areas are also contemplated. As shown, the casing racking board 120 stores or racks the casing string stands 140 within a square footage, or an area footprint 190 on the drill floor 25 and the drill string racking board 110 stores or racks the drill string stands 135 within a square footage, or a second area footprint 195 on the drill floor 25. In an exemplary embodiment, the area footprint 190 is approximately 43 sq. ft., but can be any square footage between 35 sq. ft. and 55 sq. ft. Additional sizes, both larger and smaller are also contemplated. In an exemplary embodiment, the area footprint 195 is approximately 65 sq. ft., but can be any square footage between 55 sq. ft. and 75 sq. ft. Additional sizes, both larger and smaller are also contemplated. In an exemplary embodiment, the ratio of the square footage 190 to the square footage 195 is between about 1 to 2.

Figure 6:
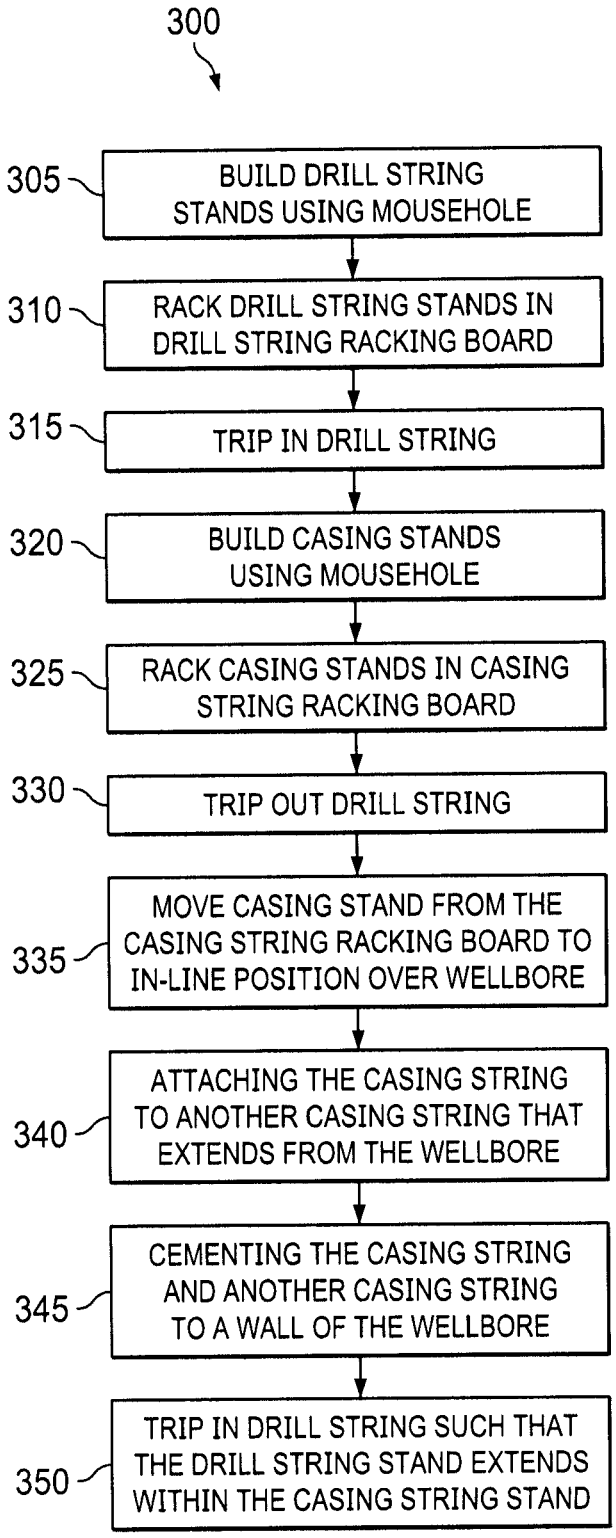
FIG. 6 is a flow chart diagram of at least a portion of a method according to one or more aspects of the present disclosure.

In an exemplary embodiment, as illustrated in FIG. 6, with continuing reference to FIGS. 1-5, a method of operating the apparatus 10 is generally referred to by the reference numeral 300. The method includes building the drill string stand 135 using the mouse hole 175 at step 305, racking the drill string stand 135 in the drill string racking board 110 at step 310, "tripping" in the drill string 105 using the drill string stand 135 at step 315, building the casing stand 140 using the mouse hole 175 at step 320, racking casing stands 140 in the casing string racking board 120 at step 325, "tripping out" the drill string 105 at step 330, moving casing stands 140 from the casing string racking board 120 to an in-line position over wellbore 35 at step 335, attaching the casing string strand 140 to another casing string stand 140 that extends from the wellbore 35 at step 340, cementing the casing string and the another casing string 140 to a wall of the wellbore 35 at step 345, and tripping in the drill string 105 such that a drill string stand 135 extends within the casing string stand 140.

At step 305, one of the drill string stands 135 is built using the mouse hole 175.

At the step 310, one of the drill string stands 135 is racked in the drill string racking board 110. At the step 310, the first end portion 135*a* is secured to the drill string racking board 110 while the middle portion 135*c* extends through the opening 170 of the casing string racking board 120 or is accommodated with the casing string racking board 120. In some embodiments, the second end portion 135*b* rests within the area 195 of the drill floor 25.

At the step 315, the drill string is "tripped in" using one or more of the drill string stands 135. This step includes moving one of the drill string stands 135 from the drill string racking board 110 and to an in-line position over the wellbore 35. The automatic stand transfer vehicle 115 may move, lower, and otherwise position the drill string stand 135.

At the step 320, a casing string stand 140 is built using the mouse hole 175. In an exemplary embodiment, a casing section is transferred from its horizontal position at its location remote from the drill floor 25 and presented by a catwalk or other conveyance to a vertical position. The casing section is then transferred into the mouse hole 175 for the building of the casing stand 140. The casing stands 140 and/or the drill string stands 135 may be built and racked simultaneous to drilling operations at well center in some embodiments.

At the step 325, the casing string stand 140 is racked in the casing string racking board 120. In some embodiments, the first end portion 140*a* of the casing string stand 140 is racked within the channels 160 of the casing string racking board 120 while the second opposing end portion 140*b* rests within the area 190 of the drill floor 25.

At the step 330, the drill string 105 is tripped out.

At the step 335, the casing stand 140 is moved from the casing string racking board 120 and to an in-line position over the wellbore 35.

At the step 340, the casing stand 140 is attached to another casing stand 140 that extends from the wellbore.

At the step 345, the casing stand 140 and the another casing stand 140 are cemented to a wall of the wellbore 35. Thus, the casing stand 140 is configured to be cemented to the wall of the wellbore 35. In some embodiments, the casing stand 140 is cemented to the wall of the wellbore 35 to prevent contamination of fresh water well zones, prevent unstable upper formations from caving and sticking to the drill string 105 or forming large caverns, isolate different zones, seal off high pressure zones from the surface, prevent fluid loss into or contamination of production zones, and/or provide a smooth internal bore for installing production equipment.

At the step 350, the drill string 105 is tripped in such that one of the drill string stands 135 extends within the casing string stand 140. In some embodiments, the drill string 105 is tripped in after the casing string stands 140 are cemented to the wall of the wellbore.

In an exemplary embodiment, the method 300 may be used make-up or break-down the drill string 100 using drill string stands 135. Due to the total length of the drill string stands 135 being greater than conventional drill string stands, the area 195 required of the drill floor 25 to accommodate a set back of 21,000 ft. of drill pipe is less than the area required to accommodate a similar set back when using drill string stands with shorter lengths. For example, a setback of 21,000 ft. of drill pipe may be stored within the area 195 when the area 195 is approximately 65 sq. ft. Due to the reduced area of the drill floor 25 used to provide a setback of 21,000 ft., the casing string stands 140 are capable of being racked (in vertical arrangement) on the drill floor 25 using the casing racking board 120. Accordingly, casing can be installed quicker than when individual sections of casing are oriented into a vertical orientation one-by-one. Moreover, with fewer connections required (due to two casing sections forming a casing stand 135), the speed at which casing can be installed increases. In an exemplary embodiment, the method 300 may increase efficiency during casing operations (i.e., placing casing into the wellbore). In an exemplary embodiment, the method 300 may result in an increased day rate.

Generally, each of the racking boards 110 and 120 store the stands 135 and 140 in a vertical position or generally vertical (within 10 degrees) position. A pipe stand may be either a casing stand 140 or a drill string stand 135. As the rig 15 includes the drill string racking board 110 and the casing string racking board 120, the rig 15 is a dual racking board rig.

The present disclosure introduces a method of operating a drilling rig that is located above a wellbore having a wellbore center, including building a casing string stand using a mouse hole that is offset from the wellbore center, wherein the casing string stand includes two sections of casing; racking the casing string stand in a casing string racking board that is coupled to a mast of the land-based drilling rig; and cementing the casing string to a wall of the wellbore. In some embodiments, the method also includes moving the casing string stand from the casing string racking board to an in-line position above the wellbore center; and attaching the casing string stand to another casing string stand that extends from the wellbore. In other embodiments, the method also includes building a drill string stand using the mouse hole, wherein the drill string has a total length greater than 110 feet and less than 140 feet; and racking the drill string stand in a drill string racking board that is coupled to the mast of the land-based drilling rig. In yet other embodiments, the casing string stand using the mouse hole that is offset from the wellbore center occurs during drilling of the wellbore. In an exemplary embodiment, the drill string racking board is coupled to a first side of a mast and extends towards a first side of the land-based drilling rig; wherein the casing string racking board is coupled to the first side of the mast and extends towards the first side of the drilling rig; and wherein the casing string racking board and the drill string racking board are spaced vertically along the mast. In an exemplary embodiment, the drill string stand has a first end portion, an opposing second end portion, and a middle portion extending between the first and second opposing end portions; wherein the first end portion of the drill string stand is accommodated between fingers that includes a portion of the casing string racking board; and wherein the middle portion of the drill string extends through a vertically extending opening formed within the casing string racking board; and wherein the second end portion contacts a drill floor of the drilling rig. In an exemplary embodiment, the casing string racking board and the drill string racking board are aligned in a first and second direction and offset in a third direction, wherein the third direction is along a height of the mast. In an exemplary embodiment, the casing string stand has a total length of between 80 ft. and 95 ft. In an exemplary embodiment, the casing string stand includes a first end portion and an opposing second end portion; wherein racking the casing string stand in the casing string racking board includes accommodating the first end portion of the casing string between fingers that includes a portion of the casing string racking board; and contacting the second end portion of the casing string on a drill floor of the drilling rig. In an exemplary embodiment, racking the casing string stand in a casing string racking board includes storing the casing string stand in a generally vertical position. In an exemplary embodiment, racking the drill string stand in the drill string racking board includes storing the drill string stand in a first predetermined area of a drill floor of the drilling rig; wherein racking the casing string stand in the casing string racking board includes storing the casing string in a second predetermined area of the drill floor; and wherein the ratio of the first predetermined area to the second predetermined area is between about 1 to 2.

The present disclosure also introduces a drilling rig that includes a vertically extending drilling mast; a first racking board coupled to the drilling mast and sized to accommodate a plurality of drill string stands, wherein each drill string stand in the plurality of drill string stands has a length greater than 110 feet and less than 140 feet; and a second racking board coupled to the drilling mast and sized to accommodate a plurality of casing string stands, wherein each casing string stand in the plurality of casing string stands has a length greater than 80 feet and less than 95 feet. In an exemplary embodiment, the second racking board includes a first racking area and a second racking area, wherein the first racking area is sized to accommodate the plurality of casing string stands, and wherein the second racking area is sized to accommodate the plurality of drill string stands. In an exemplary embodiment, the first racking board is coupled to a first side of the mast and extends towards a first side of the land-based drilling rig; wherein the second racking board is coupled to the first side of the mast and extends towards the first side of the land-based drilling rig; and wherein the first racking board and the second racking board are spaced vertically along the vertically extending drilling mast. In an exemplary embodiment, the first racking board is located above the second racking board. In an exemplary embodiment, the casing string stands include two sections of casing. In an exemplary embodiment, the rig includes the casing string stands racked in the drill string racking board and the casing string stands racked in the casing string racking board. In an exemplary embodiment, the first racking board and the second racking board are vertically spaced by a distance in a range of about 20 to 40 feet. In an exemplary embodiment, wherein the second racking board has a first area footprint on a drill floor of the land-based drilling rig for storing the plurality of drill string stands and a second area footprint on the drill floor for storing the plurality of casing string stands; wherein the ratio of the first area footprint to the second area footprint is between about 1 to 2.

The present disclosure also introduces a drilling rig that includes a vertically extending drilling mast; a first racking board coupled to and extending from a side of the drilling mast, the first racking board being arranged to accommodate a first plurality of pipe stands having a first length; and a second racking board coupled to and extending from the same side of the drilling mast, the second racking board being vertically displaced from the first racking board and being disposed to accommodate a second plurality of pipe stands having a second length different than the first length. In an exemplary embodiment, a portion of the first racking board is located directly above a portion of the second racking board. In an exemplary embodiment, the drilling rig also includes a first plurality of pipe stands in the first racking board having a length greater than 110 feet and less than 140 feet; and a second plurality of pipe stands in the second racking board having a length greater than 80 feet and less than 95 feet.

In several exemplary embodiments, the elements and teachings of the various illustrative exemplary embodiments may be combined in whole or in part in some or all of the illustrative exemplary embodiments. In addition, one or more of the elements and teachings of the various illustrative exemplary embodiments may be omitted, at least in part, and/or combined, at least in part, with one or more of the other elements and teachings of the various illustrative embodiments.

Any spatial references such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In several exemplary embodiments, while different steps, processes, and procedures are described as appearing as distinct acts, one or more of the steps, one or more of the processes, and/or one or more of the procedures may also be performed in different orders, simultaneously and/or sequentially. In several exemplary embodiments, the steps, processes and/or procedures may be merged into one or more steps, processes and/or procedures.

In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several exemplary embodiments have been described in detail above, the embodiments described are exemplary only and are not limiting, and those skilled in the art will readily appreciate that many other modifications, changes and/or substitutions are possible in the exemplary embodiments without materially departing from the novel teachings and advantages of the present disclosure. Accordingly, all such modifications, changes and/or substitutions are intended to be included within the scope of this disclosure as defined in the following claims. In the claims, any means-plus-function clauses are intended to cover the structures described herein as performing the recited function and not only structural equivalents, but also equivalent structures.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. § 112, paragraph 6 for any limitations of any of the claims herein, except for those in which the claim expressly uses the word "means" together with an associated function.

What is claimed is:

1. A method of operating a drilling rig that is located above a wellbore having a wellbore center, comprising:

building a casing string stand using a mouse hole that is offset from the wellbore center, wherein the casing string stand comprises two sections of casing;

removing the casing string stand from the mouse hole;

after removing the casing string stand from the mouse hole, racking the casing string stand in a first racking area of a casing string racking board that is coupled to a mast of the drilling rig while a plurality of drill string stands is accommodated in a second racking area of the casing string racking board;

wherein the first racking area is sized to accommodate a plurality of casing string stands in a generally vertical position; and wherein the second racking area is sized to accommodate the plurality of drill string stands in a generally vertical position;

building a drill string stand from the plurality of drill string stands using the mouse hole, wherein the drill string has a total length greater than 110 feet and less than 140 feet; and racking the drill string stand in a drill string racking board that is coupled to the mast of the drilling rig;

wherein the drill string stand has a first end portion, an opposing second end portion, and a middle portion extending between the first and second opposing end portions;

wherein the first end portion of the drill string stand is accommodated between fingers that comprise a portion of the drill string racking board;

wherein the middle portion of the drill string stand extends through a vertically extending opening formed within the second racking area of the casing string racking board; and wherein the second end portion contacts a drill floor of the drilling rig.

2. The method of claim 1, further comprising cementing the casing string stand to a wall of the wellbore.

3. The method of claim 1, wherein building the casing string stand using the mouse hole that is offset from the wellbore center occurs during drilling of the wellbore.

4. The method of claim 1, wherein the drill string racking board is directly attached to a first side of the mast and extends towards a first side of the drilling rig;

wherein the casing string racking board is directly attached to the first side of the mast and extends towards the first side of the drilling rig; and wherein the casing string racking board and the drill string racking board are spaced vertically along the mast.

5. The method of claim 1, wherein the casing string racking board and the drill string racking board are aligned in a first and second direction and offset in a third direction, wherein the third direction is along a height of the mast.

6. The method of claim 1, wherein the casing string stand comprises a first end portion and an opposing second end portion; wherein racking the casing string stand in the casing string racking board comprises:

accommodating the first end portion of the casing string between fingers located in the first racking area of the casing string racking board; and contacting the second end portion of the casing string on a drill floor of the drilling rig.

7. The method of claim 1, wherein racking the casing string stand in the casing string racking board comprises storing the casing string stand in a generally vertical position.

8. The method of claim 1, wherein racking the drill string stand in the drill string racking board comprises storing the drill string stand in a first predetermined area of a drill floor of the drilling rig; wherein racking the casing string stand in the casing string racking board comprises storing the casing string in a second predetermined area of the drill floor; and wherein the ratio of the first predetermined area to the second predetermined area is between about 1 to 2.

9. A drilling rig comprising:

a vertically extending drilling mast;

a mouse hole formed within a drill floor of the drilling rig;

a first racking board coupled to and extending from a side of the drilling mast and sized to accommodate a plurality of drill string stands, wherein each drill string stand in the plurality of drill string stands has a length greater than 110 feet and less than 140 feet;

a second racking board coupled to and extending from the same side of the drilling mast and sized to accommodate a plurality of casing string stands, wherein each casing string stand in the plurality of casing string stands has a length greater than 80 feet and less than 95 feet;

wherein the first racking board and the second racking board are positioned above the drill floor and the mouse hole; and a drill string stand, from the plurality of drill string stands, built using the mouse hole;

wherein the drill string stand is racked in the first racking board;

wherein the drill string stand has a first end portion, an opposing second end portion, and a middle portion extending between the first and second opposing end portions;

wherein the first end portion of the drill string stand is accommodated between fingers that comprise a portion of the first racking board;

wherein the middle portion of the drill string stand extends through a vertically extending opening formed within the second racking board; and wherein the second end portion contacts a drill floor of the drilling rig.

10. The drilling rig of claim 9, wherein the second racking board comprises a first racking area and a second racking area, wherein the first racking area is sized to accommodate the plurality of casing string stands; and wherein the vertically extending opening is formed within the second racking area of the second racking board.

11. The drilling rig of claim 9, wherein the first racking board extends towards a first side of the drilling rig;

wherein the second racking board extends towards the first side of the drilling rig; and wherein the first racking board and the second racking board are spaced vertically along the vertically extending drilling mast.

12. The drilling rig of claim 11, wherein the first racking board is located above the second racking board.

13. The drilling rig of claim 9, wherein each of the casing string stands comprises two sections of casing.

14. The drilling rig of claim 9, further comprising the plurality of drill string stands racked in the first racking board and the plurality of casing string stands racked in the second racking board.

15. The drilling rig of claim 11, wherein the first racking board and the second racking board are vertically spaced by a distance in a range of about 20 feet to 40 feet.

16. The drilling rig of claim 9, wherein the second racking board has a first area footprint on the drill floor of the drilling rig for storing the plurality of drill string stands and a second area footprint on the drill floor for storing the plurality of casing string stands; wherein the ratio of the first area footprint to the second area footprint is between about 1 to 2.

17. A drilling rig comprising:

a vertically extending drilling mast;

a mouse hole formed within a drill floor of the drilling rig;

a first racking board coupled to and extending from a side of the drilling mast, the first racking board being arranged to accommodate a first plurality of pipe stands having a first length;

wherein the first plurality of pipe stands is a plurality of drill string stand;

a second racking board coupled to and extending from the same side of the drilling mast, the second racking board being vertically displaced from the first racking board and being disposed to accommodate a second plurality of pipe stands having a second length different than the first length;

wherein the first racking board and the second racking board are positioned above the drill floor and the mouse hole; and a drill string stand, from the plurality of drill string stands, built using the mouse hole, wherein the drill string stand has a total length greater than 110 feet and less than 140 feet;

wherein the drill string stand is racked in the first racking board;

wherein the drill string stand has a first end portion, an opposing second end portion, and a middle portion extending between the first and second opposing end portions;

wherein the first end portion of the drill string stand is accommodated between fingers that comprise a portion of the first racking board;

wherein the middle portion of the drill string stand extends through a vertically extending opening formed within the second racking board; and wherein the second end portion contacts a drill floor of the drilling rig.

18. The drilling rig of claim 17, wherein a portion of the first racking board is located directly above a portion of the second racking board.

19. The drilling rig of claim 17, comprising:

a second plurality of pipe stands in the second racking board having a length greater than 80 feet and less than 95 feet.

* * * * *